US006921871B2

(12) United States Patent
Nakazawa et al.

(10) Patent No.: US 6,921,871 B2
(45) Date of Patent: Jul. 26, 2005

(54) SLIDE SWITCH

(75) Inventors: Takashi Nakazawa, Tokyo (JP); Tsutomu Watada, Tokyo (JP)

(73) Assignee: Niles Co., Ltd. (JP)

( * ) Notice: Subject to any disclaimer, the term of this patent is extended or adjusted under 35 U.S.C. 154(b) by 0 days.

(21) Appl. No.: 10/667,598

(22) Filed: Sep. 23, 2003

(65) Prior Publication Data

US 2004/0074750 A1 Apr. 22, 2004

(30) Foreign Application Priority Data

Sep. 25, 2002 (JP) ..... P2002-278987

(51) Int. Cl.[7] ..... H01H 21/54
(52) U.S. Cl. ..... 200/16 R; 200/16 A; 200/549
(58) Field of Search ..... 200/16 R, 16 A, 200/549, 550, 275, 252, 280, 557, 260

(56) References Cited

U.S. PATENT DOCUMENTS 4,983,795 A * 1/1991 Suzuki ..... 200/550
5,365,028 A * 11/1994 Takano ..... 200/547
5,720,385 A * 2/1998 Uchiyama ..... 200/549

* cited by examiner

*Primary Examiner*—Richard K. Lee
(74) *Attorney, Agent, or Firm*—Rader, Fishman & Grauer PLLC

(57) ABSTRACT

To enable to restrain a portion only of a resin at a pole board made of the resin to restrain warp or a sink mark, in a slide switch including a pole board 3 made of a resin insert-molded with fixed contacts 9, 11, 13, 15 and 17 and a movable board supporting a movable contact and capable of sliding the movable contact relative to the fixed contacts 9, 11, 13, 15 and 17 by predetermined contact pressure by moving along the pole board 3, a metal plate 21 is insert-molded to a portion of the pole board 1 at which the fixed contacts 9, 11, 13, 15 and 17 are not present.

8 Claims, 9 Drawing Sheets

SLIDE SWITCH

BACKGROUND OF THE INVENTION

1. Field of the Invention

The present invention relates to a slide switch used in an inhibitor switch for detecting a shift position of an automobile.

2. Description of the Related Art

As a slide switch of a related art, there is an inhibitor switch shown by, for example, FIG. 10. The inhibitor switch 101 is provided with a pole board 103 and a movable board 105. The pole board 103 is formed by a resin and fixed contacts 107, 109, 111, 113 and 115 are insert-molded thereto. The movable board 105 is formed by a resin and supports a movable contact 117. The movable board 105 is constituted to move along the pole board 103 and slide respective contact portions of the movable contact 117 relative to the fixed contacts 107, 109, 111, 113 and 115 by predetermined contact pressure. Further, a cover 121 is calked to bond with the pole board 103.

Further, when the movable board 105 is moved in cooperation with a manual valve, the movable contact 117 selectively conducts the fixed contacts 107, 109, 111, 113 and 115 to thereby enable to detect a shift position of an automatic transmission (refer to Patent Literature 1).

(Patent Literature 1)

JP-A-10-134672 (page 3, FIG. 1)

Meanwhile, the respective fixed contacts 107, 109, 111, 113 and 115 of the pole board 103 are formed such that lengths thereof differ from each other in order to selectively connect by the movable contact 117.

Therefore, there is formed a portion only of resin 119 at which the contact points 107, 109 and the like made of a metal are not present at the pole board 103 made of a resin. As shown by FIG. 11 which is a sectional view enlarging an essential portion in view from arrow marks SA—SA of FIG. 10, a molding shrinkage amount of a region S1 of the portion only of resin 119 differs from that of a region S2 at which the fixed contact point 107 is present, a phase difference is brought about in shrinking and there poses a problem that the region S1 of the portion only of resin 119 is warped relative to the region S2 of the portion at which the fixed contact 107 is present.

Therefore, there is a concern of effecting adverse influence on accuracy of detecting the shift position by switching ON/OFF by the fixed contacts 107, 109 and the like and the movable contact 117.

SUMMARY OF THE INVENTION

It is a problem of the invention to provide a slide switch capable of reducing occurrence of warp or a sink mark of a pole board.

A first aspect of the invention is a slide switch comprising a pole board made of a resin insert-molded with a fixed contact, and a movable board supporting a movable contact and capable of sliding the movable contact relative to the fixed contact by a predetermined contact pressure by moving along the pole board, wherein a metal plate is insert-molded at a portion at which the fixed contact of the pole board is not present.

A second aspect of the invention is the slide switch according to the first aspect, wherein the metal plate is integrally extended from the fixed contact.

A third aspect of the invention is the slide switch according to the first or the second aspect, wherein the metal plate is embedded in the pole board.

According to the first aspect of the invention, the movable contact of the movable board can be slid relative to the fixed contact of the pole board by the predetermined contact pressure by moving the movable board along the pole board made of the resin insert-molded with the fixed contact.

Further, since the metal plate is insert-molded to the portion of the pole board at which the fixed contact is not present and therefore, a molding shrinkage amount can be equalized over the total of the pole board, occurrence of warp or a sink mark can be reduced and promotion of dimensional accuracy can be achieved.

Therefore, accuracy of switching ON/OFF of the switch can be promoted.

According to the second aspect of the invention, in addition to an effect of the first aspect of the invention, the metal plate is integrally extended from the fixed point and therefore, the metal plate can be dealt with integrally with the fixed contact, a number of parts is reduced and integration and part control can extremely be facilitated.

According to the third aspect of the invention, in addition to the effect of the first or the second aspect of the invention, the metal plate is embedded in the pole board and therefore, the metal plate can be prevented from causing shortcircuit when the slide switch is exposed to oil including worn powders or when a foreign matter on the wall pole board is mixed.

DETAILED DESCRIPTION OF THE PREFERRED EMBODIMENTS (First Embodiment)

Figure 1:
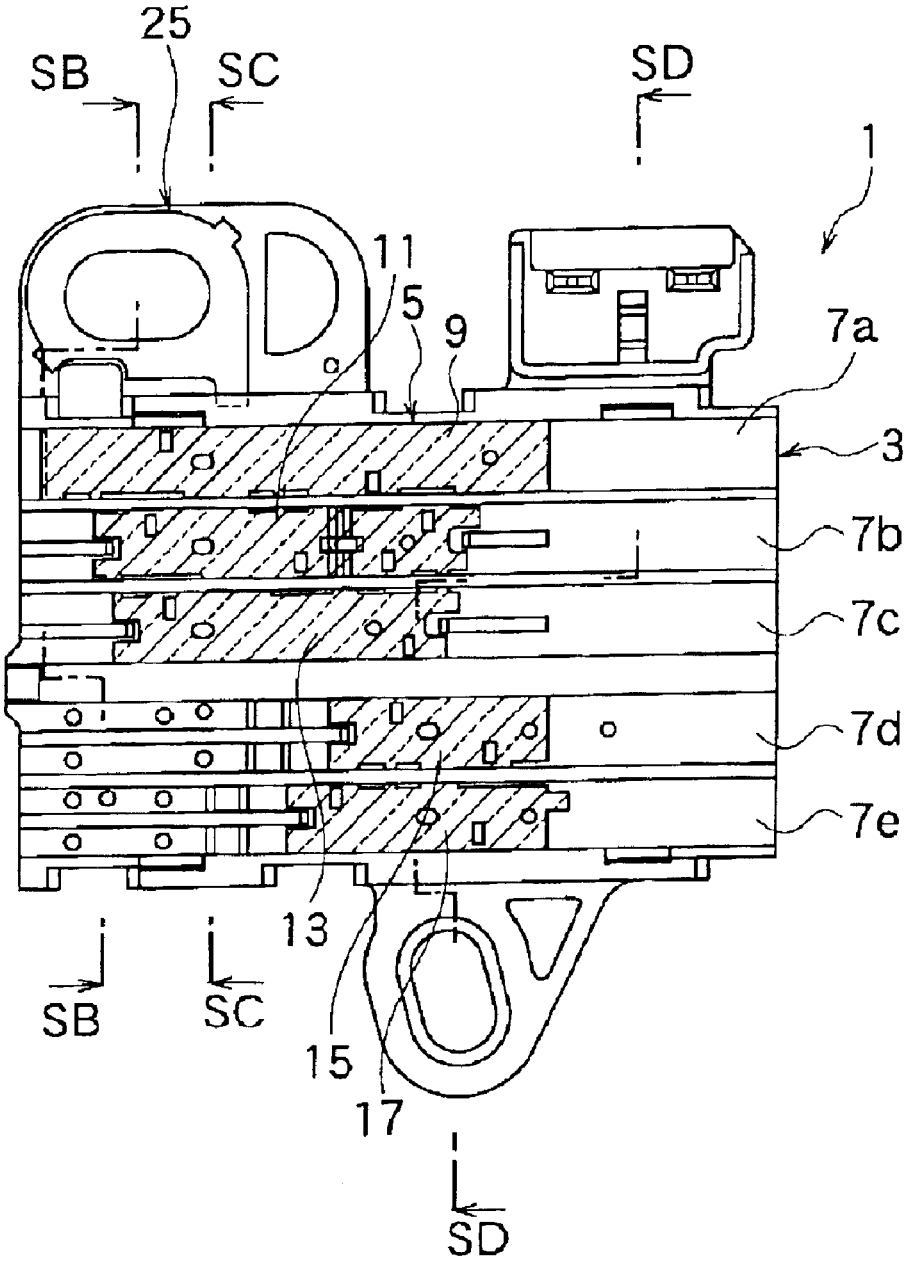
FIG. 1 is a plane view of a pole board of an inhibitor switch according to a first embodiment of the invention.
Figure 2:
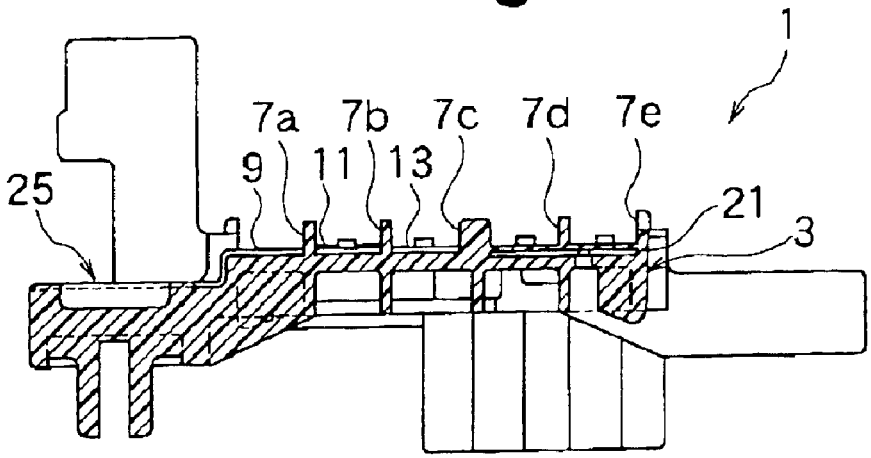
FIG. 2 is a sectional view in view from arrow marks SB—SB of FIG. 1 according to the first embodiment.
Figure 3:
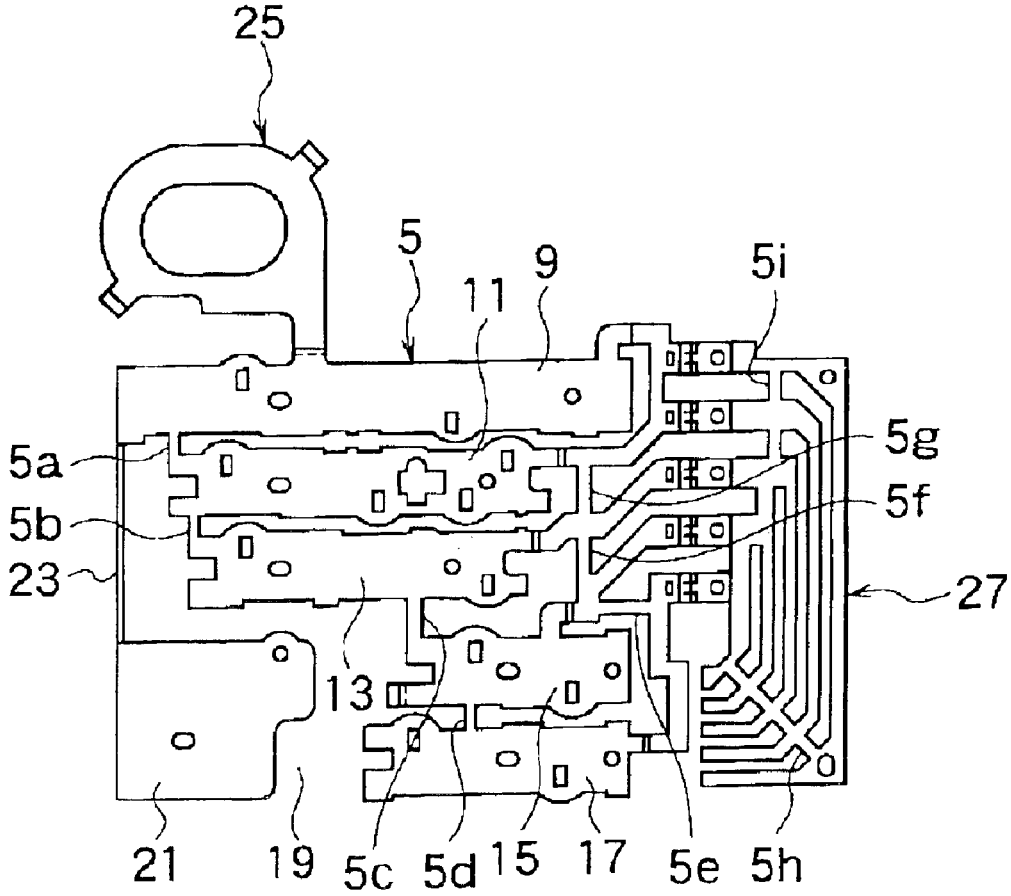
FIG. 3 is a plane view of a contact plate according to the first embodiment.
Figure 4:
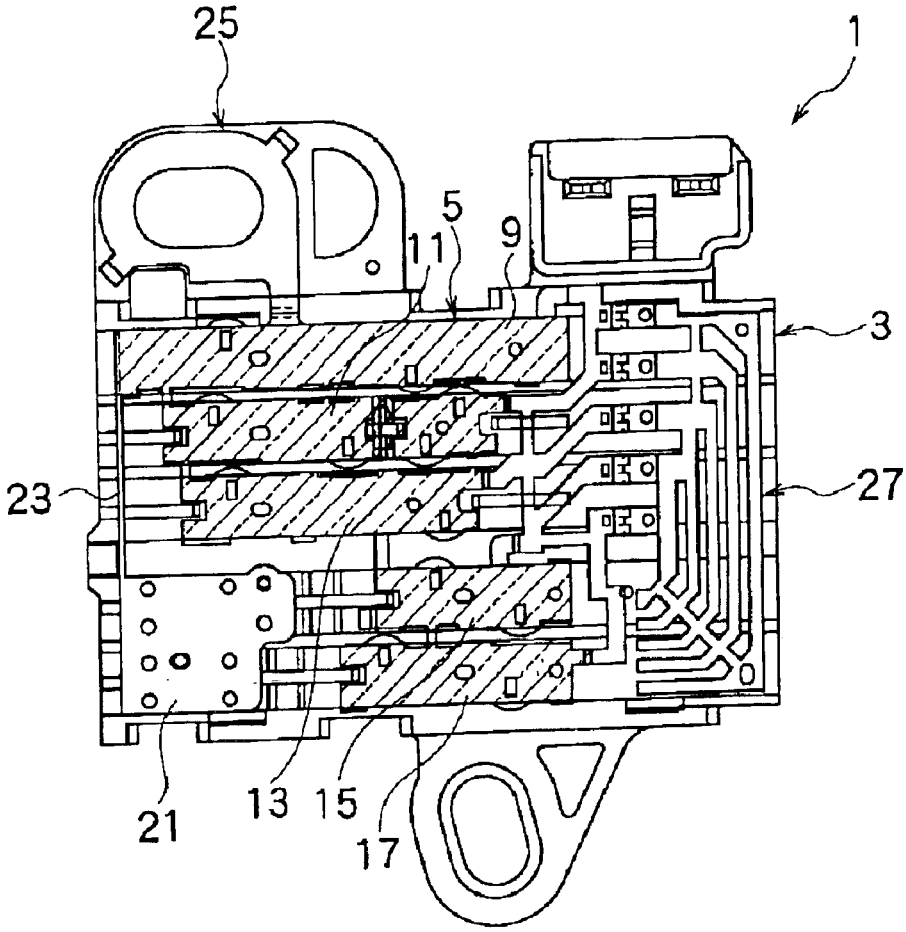
FIG. 4 is a plane view of a state of overlapping the contact plate on a pole board main body according to the first embodiment.

FIG. 1 through FIG. 4 relate to an inhibitor switch for detecting a shift position of an automatic transmission of an automobile as a slide switch according to a first embodiment of the invention, FIG. 1 is a plane view of a pole board of an inhibitor switch, FIG. 2 is a sectional view in view from arrow marks SB—SB of FIG. 1, FIG. 3 is a plane view of a contact plate and FIG. 4 is a plane view of a state of simply overlapping the contact plate on the pole board.

Figure 10:
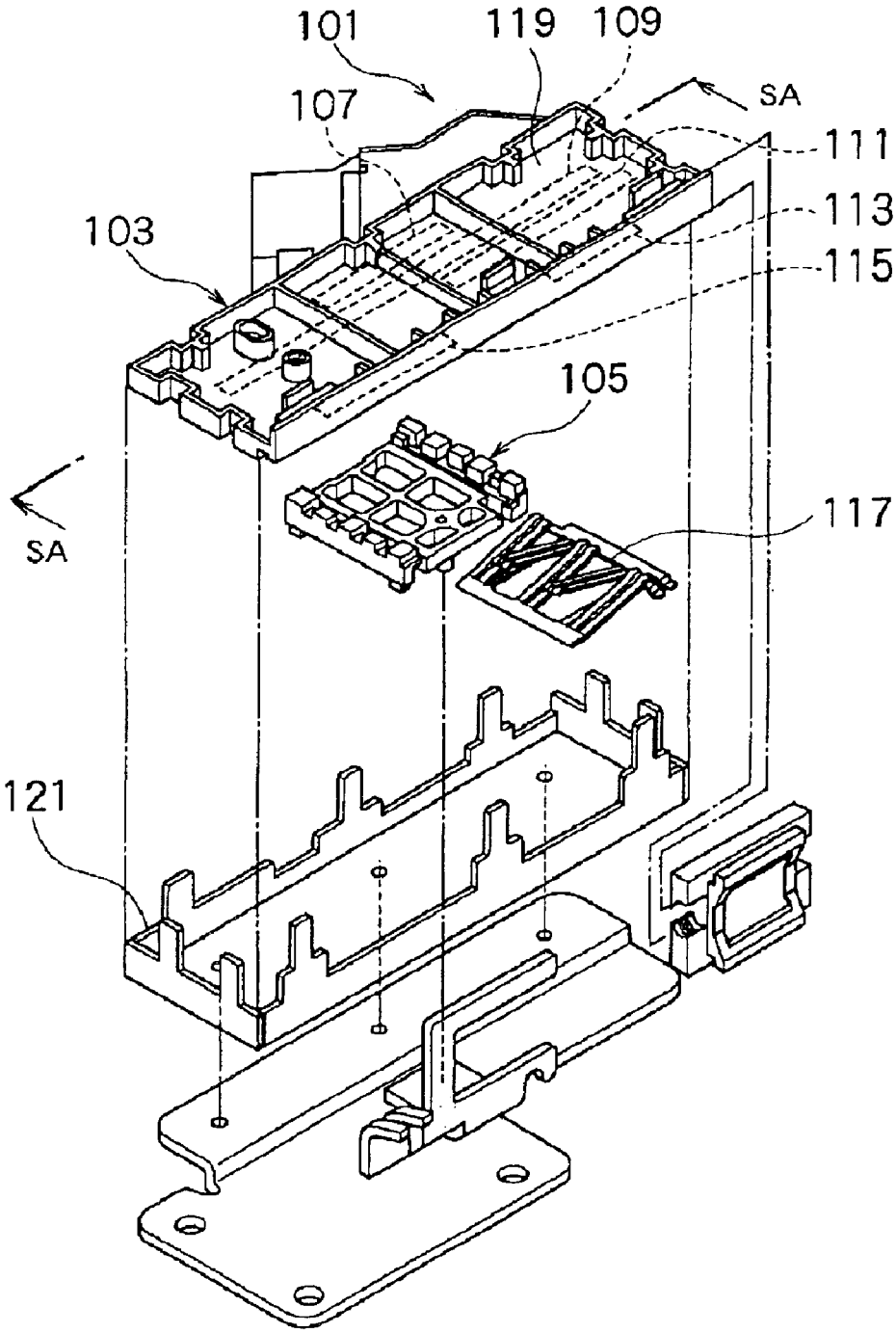
Fig.10 PRIOR ART
FIG. 10 is a perspective view of an inhibitor switch according to a related art.
Figure 11:
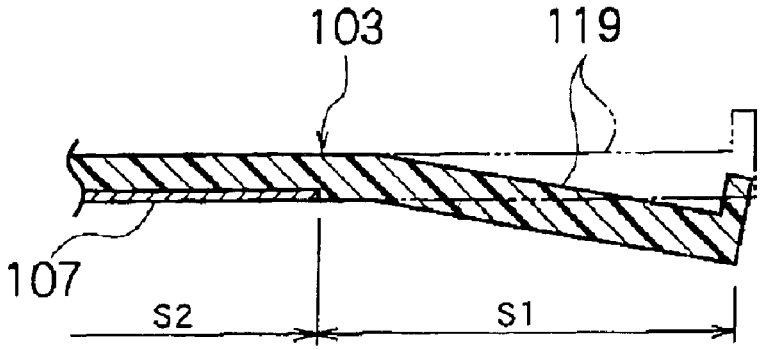
Fig.11 PRIOR ART
FIG. 11 is a sectional view enlarging an essential portion in view from arrow marks SA—SA of FIG. 10 according to the related art.

The inhibitor switch according to the embodiment is supported at, for example, inside of a transmission case of an automatic transmission and is brought into a situation of being exposed to oil at high temperature including worn powders. Further, a pole board 1 constitutes the inhibitor switch along with a movable board having a movable contact and a cover by a constitution similar to that of FIG. 10 although a mode thereof differs therefrom.

As shown by FIG. 1 and FIG. 2, the pole board 1 is provided with a pole board main body 3 and a contact plate 5. The pole board main body 3 is provided with grooves 7*a*, 7*b*, 7*c*, 7*d* and 7*e* for sliding movable contacts. The contact plate 5 is formed by a metal of stainless steel or the like and is provided with fixed contacts 9, 11, 13, 15 and 17. The fixed contact 9 is formed to be long such that the movable contact is always brought into contact therewith to constitute a ground electrode. The fixed contacts 11, 13, 15 and 17 are formed respectively in predetermined lengths for selectively connecting ON/OFF by the movable contacts. Particularly, as shown by FIG. 3, the fixed contacts 15 and 17 are formed to be short and a space portion 19 in which a fixed contact is not present is formed at an interval from a side of the fixed contact 13.

Hence, according to the embodiment, as shown by FIG. 3, a metal plate 21 is arranged at the space portion 19. The metal plate 21 is extended integrally from the fixed contact 9 of the ground electrode via an arm portion 23. Further, whereas the respective fixed points 9, 11, 13, 15 and 17 are arranged on the same plane, the metal plate 21 is formed at a stage different from the plane of the respective fixed contacts 9, 11, 13, 15 and 17 and formed more or less lower than the plane in a direction orthogonal to the paper face of FIG. 3 to a rear side of the paper face. Further, terminals 25 and 27 are integrally provided to the contact plate 5.

The contact plate 5 is arranged as shown by FIG. 1 relative to the pole board main body 3 made of the rein by insert-molding the resin. As shown by FIG. 1 and FIG. 2, surfaces of the respective fixed contacts 9, 11, 13, 15 and 17 of the contact plate 5 are exposed in the groove portions 7*a*, 7*b*, 7*c*, 7*d* and 7*e* and set to be flush with each other in the groove portions 7*a*, 7*b*, 7*c*, 7*d* and 7*e*. Further, the contact plate 5 is formed by punching a conductive metal plate, intervals among the respective fixed contacts 9, 11, 13, 15 and 17 are connected by connecting portions 5*a*, 5*b*, 5*c*, 5*d*, 5*e*, 5*f* and 5*g* and the terminal 27 is connected thereto by connecting portions 5*h* and 5*i*, however, the connecting portions 5*a* through 5*g* and 5*h*, 5*i* are cut after insert-molding.

The metal plate 21 is set to be lower than the respective fixed contacts 9, 11, 13, 15 and 17 by one stage and therefore, brought into a state of being embedded in the pole board main body 3 as shown by FIG. 2.

Here, FIG. 4 shows a state in which the contact plate 5 is overlapped on the pole board main body 3 simply from the plane. As is apparent from the overlapped state of FIG. 4, although the pole board main body 3 made of the resin is inherently to be formed with a portion only of the resin by presence of the space portion 19 shown in FIG. 3, according to the embodiment of the invention, the metal plate 21 is present also at the portion.

Therefore, the portion only of the resin is restrained at a substantially over a total of the pole board main body 3 made of the resin by the contact plate 5 and shrinkage of the resin in insert-molding can be made to be uniform as a whole and occurrence of warp or a sink mark of the pole board main body 3 can be reduced.

Therefore, when the movable contacts slide relative to the fixed contacts 9, 11, 13, 15 and 17 and the shift position of the automatic transmission is detected by switching ON/OFF, accuracy of switching ON/OFF can be promoted and the shift position can accurately be detected.

Further, even when the pole board and the cover is subjected ultrasonic welding, a reduction can be carried out also at a portion at which the fixed contact 9 is not present by a calculated value of strength similar to that of a portion at which the fixed contact 9 is present and a degree of freedom of design of a welded portion can be increased.

Further, the metal plate 21 is brought into a state of being embedded in the pole board main body 3 and is brought into a state of not being exposed to outside. Therefore, even when exposed to oil including worn powders, shortcircuit caused by the metal plate 21 can be prevented.

Figure 5:
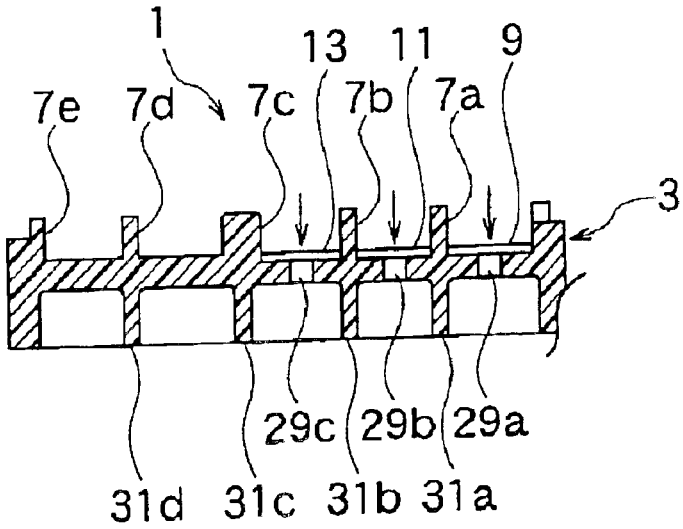
FIG. 5 is a sectional view of an essential portion in view from arrow marks SC—SC of FIG. 1 according to the first embodiment.
Figure 6:
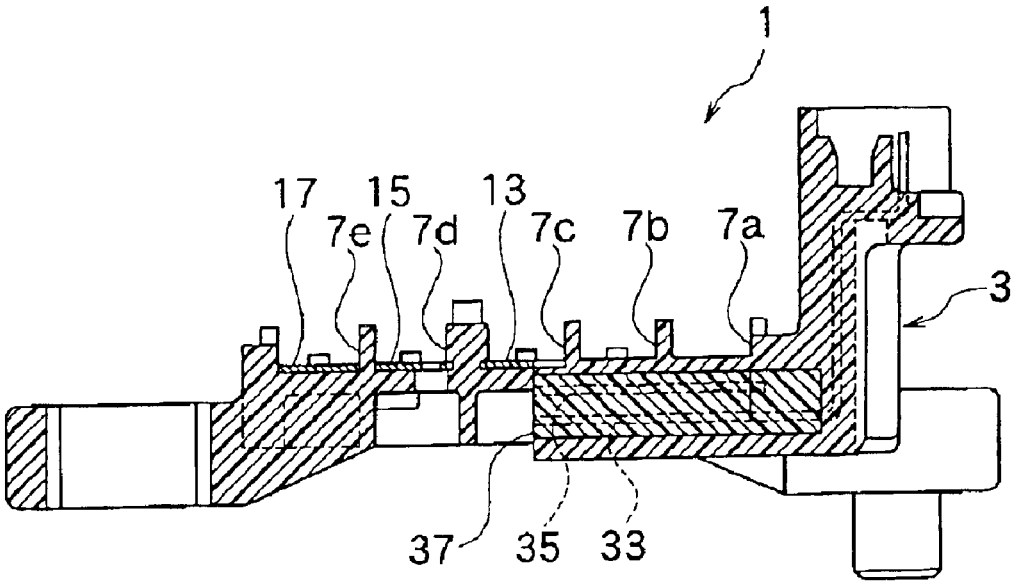
FIG. 6 is a sectional view in view from arrow marks SD—SD of FIG. 1 according to the first embodiment.

Further, according to the embodiment, shortcircuit among the contacts is prevented as shown by FIG. 5 and FIG. 6. FIG. 5 is a sectional view of an essential portion in view from arrow marks SC—SC of FIG. 1 and FIG. 6 is a sectional view in view from arrow marks SD—SD of FIG. 1.

The contact plate 5 needs to hold in insert-molding to the pole board main body 3 and therefore, as shown by FIG. 5, holes 29*a*, 29*b* and 29*c* are formed at the pole board main body 3 on the rear sides of the fixed contacts 9, 11 and 13. Therefore, also on the rear sides of the fixed contacts 9, 11 and 13, the fixed contacts 9, 11 and 13 having different potentials are exposed at the holes 29*a*, 29*b* and 29*c*.

Hence, according to the embodiment, as shown by FIG. 5, the pole board main body 3 is provided with ribs 31*a*, 31*b*, 31*c* and 31*d*. Creep distances among the fixed contacts 9, 11 and 13 having different potentials exposed by the holes 29*a*, 29*b* and 29*c* can be prolonged by the ribs 31*a*, 31*b*, 31*c* and 31*d* and shortcircuit among the contacts can firmly be restrained.

Further, when conductor portions 33 and 35 constitute two layers or more as shown by FIG. 6 and cannot be held by upper and lower dies, the two layers or more of the conductor portions 33 and 35 are integrated by a resin portion 37 previously by primary molding and insert-molded to the pole board main body 3 while holding the resin portion 37 by upper and lower dies by secondary molding. Therefore, the conductor portions 33 and 35 are not exposed and electric shortcircuit can be prevented at the portions.

(Second Embodiment)

Figure 7:
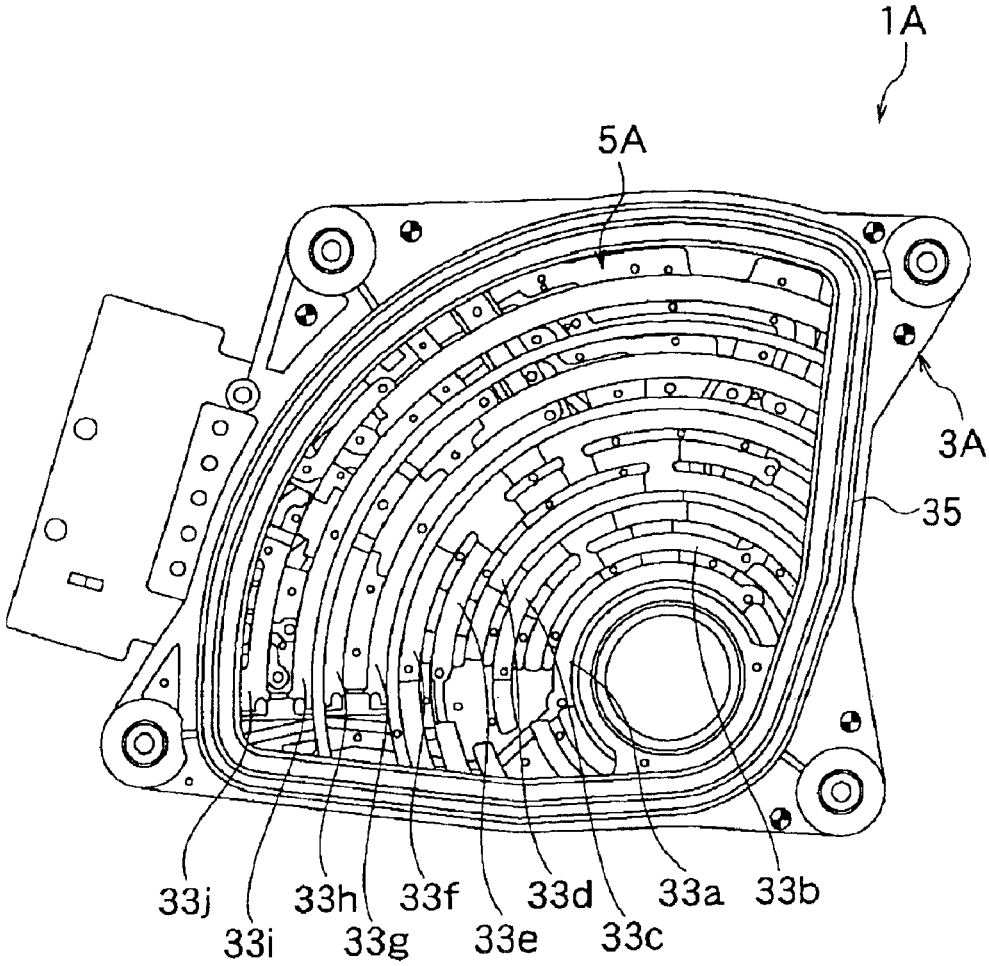
FIG. 7 is a plane view showing a pole board of an inhibitor switch according to a second embodiment of the invention.
Figure 8:
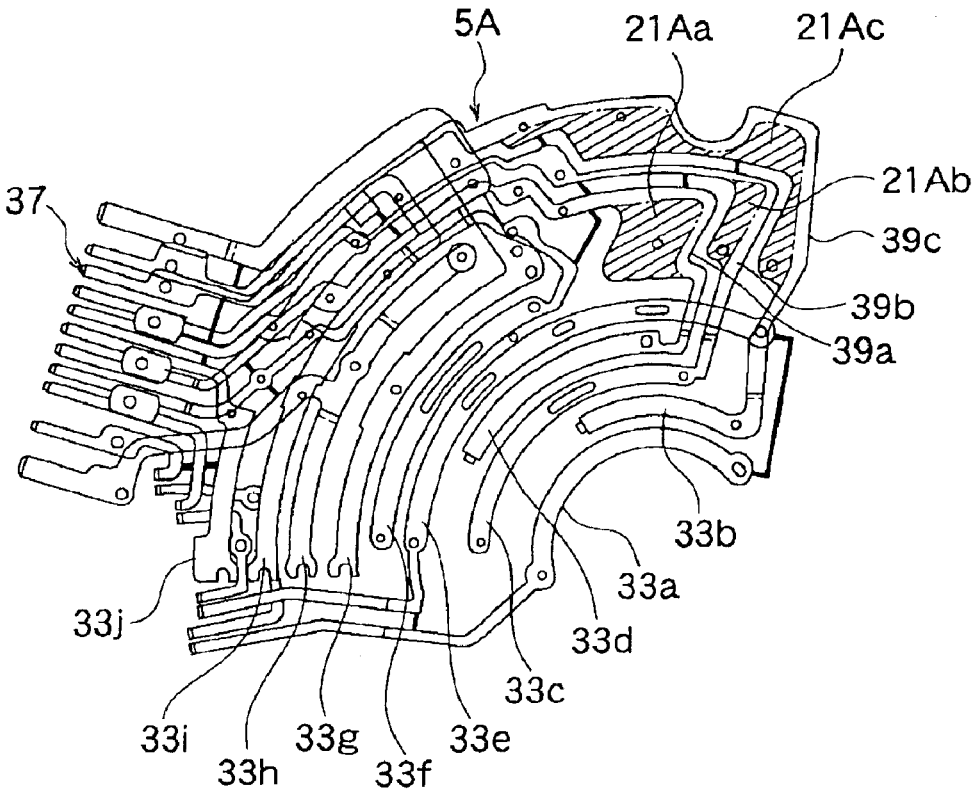
FIG. 8 is a plane view of a contact plate according to the second embodiment.
Figure 9:
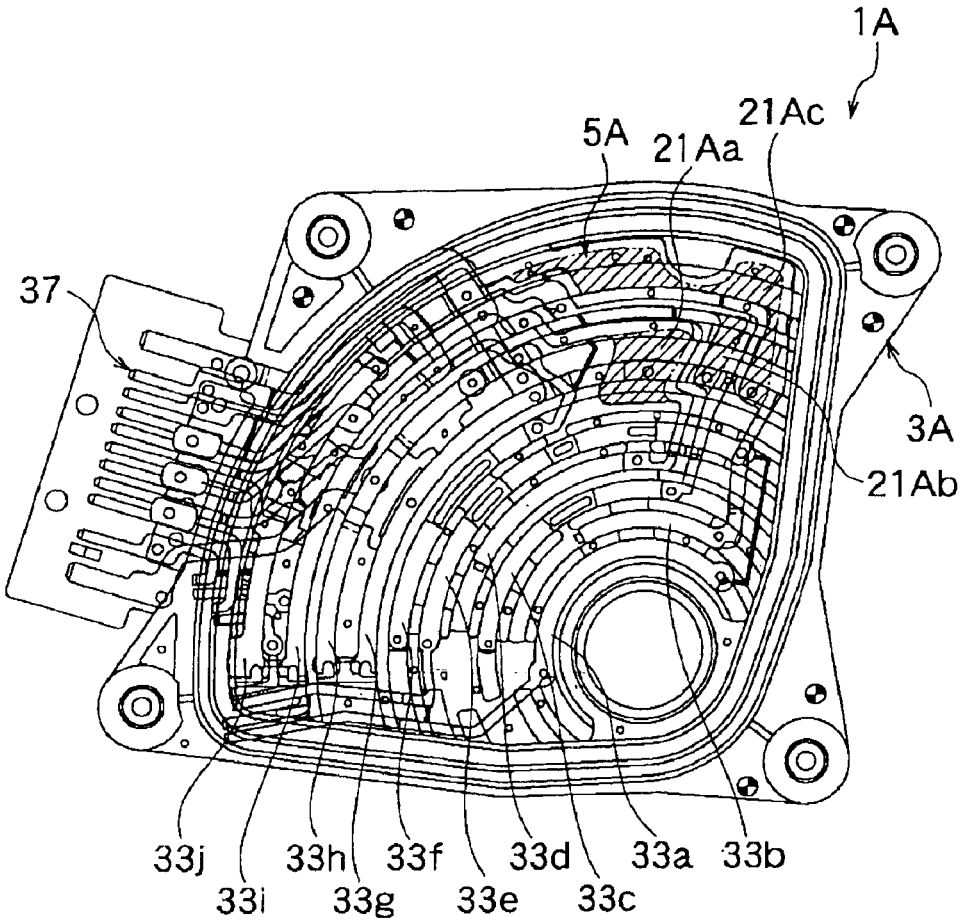
FIG. 9 is a plane view of a state of overlapping the contact plate on a pole board main body according to the second embodiment.

FIG. 7 through FIG. 9 relate to a second embodiment of the invention, FIG. 7 is a plane view of a pole board, FIG. 8 is a plane view of a contact plate and FIG. 9 is a plane view of a state of overlapping the contact plate on a pole board main body.

A slide switch according to the embodiment is attached to, for example, an outer side of a transmission case of an automatic transmission. Therefore, although the slide switch of the embodiment is not exposed to oil including worn powders as in the first embodiment, the slide switch is exposed to rain water or the like.

Also in the embodiment, similar to the first embodiment, a contact plate 5A having fixed contacts 33*a*, 33*b*, 33*c*, 33*d*,

33*e*, 33*f*, 33*g*, 33*h*, 33*i* and 33*j* is provided to a pole board main body 3A made of a resin, of a pole board 1A by insert-molding.

The pole board main body 3A is provided with a seal portion 35 to surround the fixed contacts 33*a* through 33*j*. Sealing performance is maintained between the pole board main body 3A and a cover, not illustrated, by fitting an O ring to the seal portion 35.

Therefore, also according to the embodiment in which an inhibitor switch is attached to the outer side of the transmission case, the fixed contacts 33*a* through 33*j* can be protected against scattering of rain water or the like.

The contact plate 5A is provided with metal plates 21Aa, 21Ab and 21Ac similar to the first embodiment. The metal plates 21Aa, 21Ab and 21Ac are newly provided to the contact plate 5A at hatched portions.

That is, inherently, the fixed contact 33*b* and the like may be conducted to a side of a terminal 37 and slender portions of conductive portions 39*a*, 39*b* and 39*c* excluding the hatched portions of the metal plates 21Aa, 21Ab and 21Ac may be present. However, thereby, a large space is formed on inner sides of the conductive portions 39*a*, 39*b* and 39*c* and when the contact plate 5A is insert-molded to the pole board main body 3A, a portion only of the resin is formed on the inner sides of the conductive portions 39*a*, 39*b* and 39*c*. In this case, as is apparent from a state of overlapping the contact plate 5A on the pole board main body 3A of FIG. 9, when the contact plate 5A is insert-molded to the pole board main body 3A, the portion only of the resin is restrained by presence of the metal plates 21Aa, 21Ab and 21Ac.

Therefore, also according to the embodiment, operation and effect similar to those of the first embodiment, that is, a reduction in occurrence of warp or a sink mark of the pole board, promotion of accuracy of detecting the shift position and provision of the degree of freedom of design of the portions subjected to ultrasonic welding can be achieved.

Further, according to the embodiment, the metal plates 21Aa, 21Ab and 21Ac are not particularly conducted to a fixed contact constituting a ground electrode but are integrally extended from the conductive portions 39*a*, 39*b* and 39*c* most proximate to the metal plates 21Aa, 21Ab and 21Ac. This is because the inhibitor switch of the embodiment is attached to outside of the transmission case and is not exposed to oil including worn powders and therefore, even when the metal plates are not integrally extended from the fixed contact constituting the ground electrode as in the first embodiment, shortcircuit can be restrained.

According to the embodiment, the shape of the seal portion 35 can accurately be maintained by restraining warp or the sink mark of the pole board main body 3A and sealing by the O ring can firmly be carried out.

Further, the invention is not limited to the above-described embodiment. For example, although according to the embodiment, the metal plate is integrally extended from the fixed point, a separate metal plate can also be insert-molded thereto.

Further, the metal plate can also be arranged to expose to the surface of the pole board.

What is claimed is:

1. A slide switch comprising:

a pole board made of a resin insert-molded with a fixed contact; and a movable board supporting a movable contact or sliding the movable contact relative to the fixed contact by a predetermined contact pressure by moving along the pole board; wherein a metal plate is insert-molded in a portion of the pole board in which the fixed contact is not present.

2. The slide switch according to claim 1, wherein the metal plate is integrally extended from the fixed contact.

3. The slide switch according to claim 1 or 2, wherein the metal plate is embedded in the pole board.

4. The slide switch according to claim 1, wherein the metal plate is formed on a plane below that of the fixed contact.

5. A slide switch comprising:

a pole board made of a resin insert-molded with a fixed contact; and a movable board supporting a movable contact for sliding the movable contact relative to the fixed contact by a predetermined contact pressure by moving along the pole board; wherein a metal plate is insert-molded in a portion of the pole board in which the fixed contact is not present to provide uniform shrinkage throughout the pole board.

6. The slide switch according to claim 5, wherein the metal plate is integrally extended from the fixed contact.

7. The slide switch according to claim 5, wherein the metal plate is embedded in the pole board.

8. The slide switch according to claim 5, wherein the metal plate is formed on a plane below that of the fixed contact.

* * * * *